US007396256B2

(12) United States Patent
Mahaffy

(10) Patent No.: US 7,396,256 B2
(45) Date of Patent: Jul. 8, 2008

(54) FILTER CONNECTOR WITH HIGH FREQUENCY SHIELD

(75) Inventor: Neil Allan Mahaffy, Riverside, CA (US)

(73) Assignee: ITT Manufacturing Enterprises, Inc., Wilmington, DE (US)

( * ) Notice: Subject to any disclaimer, the term of this patent is extended or adjusted under 35 U.S.C. 154(b) by 0 days.

(21) Appl. No.: 11/978,885

(22) Filed: Oct. 30, 2007

(65) Prior Publication Data

US 2008/0119089 A1 May 22, 2008

(51) Int. Cl.
*H01R 13/66* (2006.01)

(52) U.S. Cl. ..... 439/620.09

(58) Field of Classification Search ..... 439/620.07, 439/620.08, 620.09, 620.1
See application file for complete search history.

(56) References Cited

U.S. PATENT DOCUMENTS 6,364,712 B2 * 4/2002 Durr et al. ..... 439/620.09
6,508,672 B1 * 1/2003 Safai ..... 439/620.1
6,896,552 B2 5/2005 Kosmala
7,014,507 B1 * 3/2006 Kosmala ..... 439/620.07

* cited by examiner

*Primary Examiner*—Tho D Ta
(74) *Attorney, Agent, or Firm*—Peter Van Winkle

(57) ABSTRACT

A shield is provided that blocks high frequency EMI (electromagnetic interference) from reaching circuitry that is connected to pins of a filter connector. The filter connector includes a plurality of pins (12) that extend through holes (92) in first boards (26), with each pin joined by a solder joint (90) to a signal trace (32, 60) that surrounds the pin hole. Filter components such as capacitors (40), each have one terminal (44) joined to a signal trace and another terminal (42) joined to a ground trace (30), with a gap (62) between the traces. Second boards (75) are provided that each lies facewise adjacent to a first board and that each carries a shield trace (72) that covers the gap between signal and ground traces. The pin-receiving hole in each second board has a circular portion and has a notch (100) therein though which a solder dispenser (102) can fit to dispense solder directly into the space between and on the pin and the signal traces.

11 Claims, 3 Drawing Sheets

FILTER CONNECTOR WITH HIGH FREQUENCY SHIELD

BACKGROUND OF THE INVENTION

One type of filter connector, described in U.S. Pat. No. 6,896,552, includes a pair of flexible circuit boards or board portions, with holes though which pins extend. A signal trace that extends is a ring around each hole is electrically connected by a solder joint to a corresponding pin. Filter components such as capacitors, each has one terminal connected to the signal trace and another terminal connected to a ground plane. There is a gap between the signal trace and ground plane, and high frequency (500 MHz to 1000 MH) stray signals may pass though such a gap, to circuitry that is connected to one end of the pins. Such stray signals constitute EMI (electromagnetic interference) that results in "noise" in the circuitry. A device that blocked a high portion of such EMI from passing though such a gap, would be of value.

SUMMARY OF THE INVENTION

In accordance with one embodiment of the present invention, a high frequency EMI (electromagnetic interference) shield is provided for a filter connector of the type wherein there is a gap between a ground trace and each of a plurality of signal traces. Also, the EMI shield is constructed to facilitate soldering of the signal traces to pins that project though holes in the signal traces. The filter connector is of the type wherein filter components such as capacitors are positioned on a first insulative board with one capacitor terminal connected to a signal trace (that connects to a pin) and with a second terminal connected to a ground plane on the board. A gap must be left between the ground and signal traces to prevent short circuiting. High frequency EMI can pass though such a gap to circuitry that is connected to one end of the pins. The present invention provides a second insulative board that carries a conductive trace that functions as an EMI shield. The shield trace lies in a plane that is only slightly spaced from the first board (with a dielectric layer between them). The shield trace covers the gap, and the shield trace may be coupled to the signal trace. Any EMI passing though the gap between the ground and signal traces, is intercepted by the shield trace and does not reach circuitry that is connected to one end of the pins.

Each pin is soldered to a signal trace that lies on the first circuit board that lies below the second board. To enable solder to be applied through the second board to the signal trace on the first board, the pin-receiving holes in the second board have notches. Each hole in the second board includes a circular portion that closely receives a pin and a notch that extends from the circular portion. A dispenser that dispenses a quantity of solder (and solder flux) can be inserted though the notch to dispense solder at the level of the signal trace on the first board, to assure a large area connection thereat. The solder also may flow to part of the shield trace at the circular part of the hole, to connect the shield trace to the pin and the signal trace.

The novel features of the invention are set forth with particularity in the appended claims. The invention will be best understood from the following description when read in conjunction with the accompanying drawings.

DESCRIPTION OF THE PREFERRED EMBODIMENTS

Figure 1:
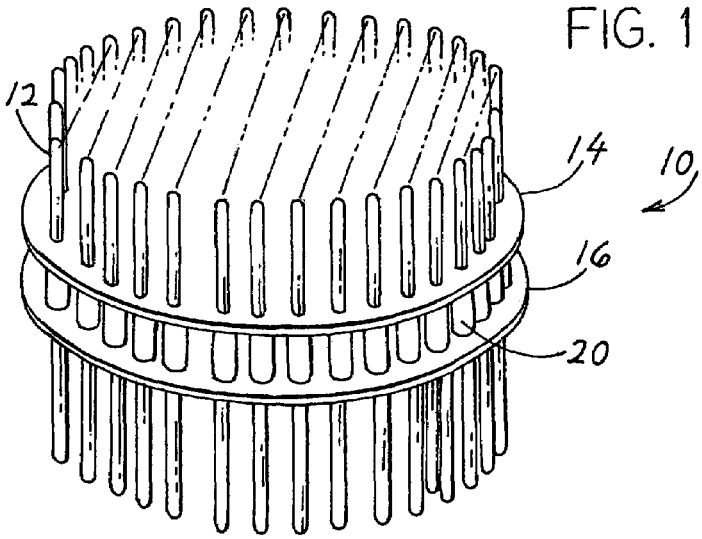
FIG. 1 is an isometric view of a filtered connector of the present invention.
Figure 2:
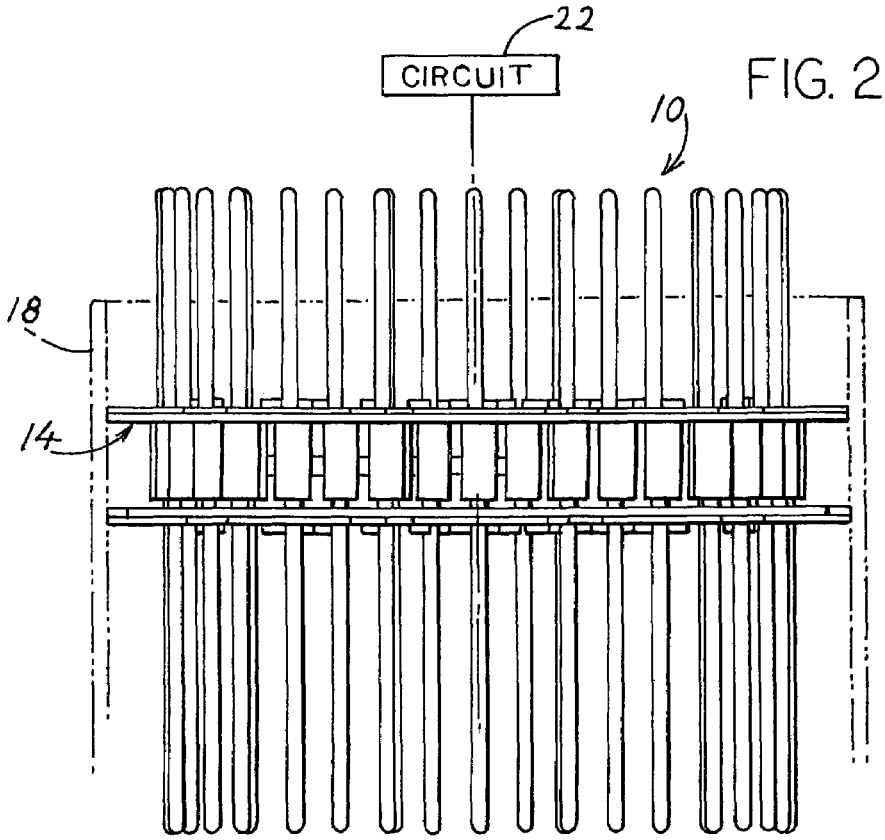
FIG. 2 is a side elevation view of the connector of FIG. 1.

FIG. 1 shows a prior art filtered connector 10, which includes a plurality of pins 12 mounted on a pair of circuit board combinations 14, 16. A filter connected to each pin includes a ferrite bead 20 and a pair of capacitors each mounted on one of the circuit board assemblies. The ferrite bead and pair of capacitors form a Pi filter, as is described in U.S. Pat. No. 6,896,552. The filtered connector is designed to be mounted in a grounded metal shell 18 as shown in FIG. 2. One end of the pins connects to sensitive circuitry 22 that lies in an extension of the grounded metal shell, the shell protecting such circuitry from EMI (electromagnetic interference). However, there is a possibility that EMI will reach the circuitry by leaking though the connector 10, and the present invention is directed to a connector construction that minimizes such EMI leakage.

Figure 3:
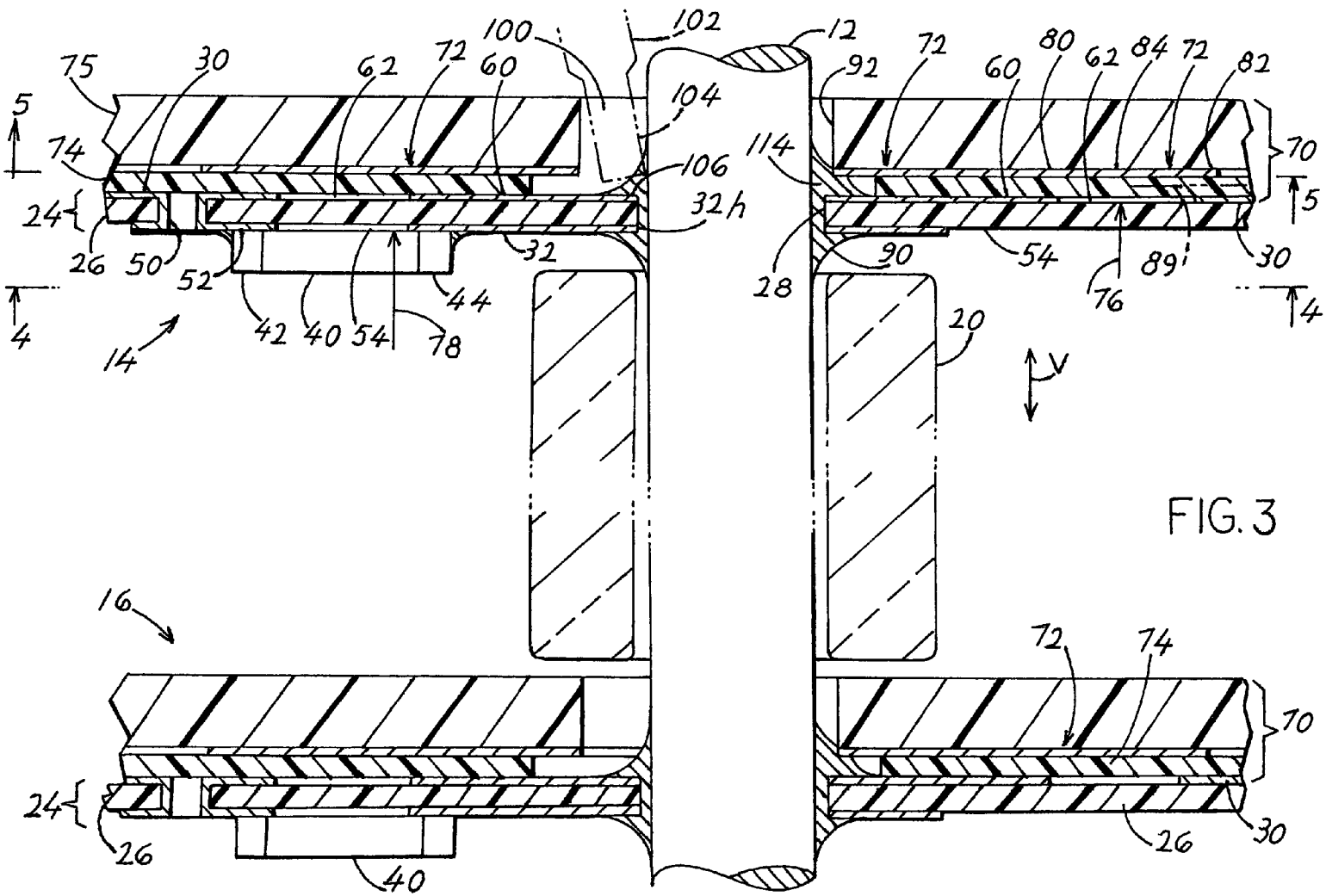
FIG. 3 is a sectional side view of a portion of the connector of FIG. 1, showing one pin and portions of the two circuit board assemblies connected to the pin.

FIG. 3 shows a portion of one of the pins 12 and of the two circuit board combinations 14, 16 that lie along the pin. Each circuit board combination such as 14, includes a first circuit board assembly 24 that includes a dielectric board 26, which may be a flexible board. The board 26 has pin receiving holes 28 that each receives one of the conductive pins 12. A ground plane 30 in the form of a conductive layer or trace, lies primarily on the upper face of the first board, and a plurality of conductive signal traces 32, 60 each lies on the first board. Each upper signal trace 60 extends in a ring around the pin hole. The lower signal trace 32 may lie on only one side of the pin hole to reach a capacitor terminal 44.

A filter component 40 such as a capacitor, has one terminal 42 connected to the ground plane 30 and has another terminal 44 connected to the signal trace 32. The circuit board has a plated-through aperture 50 that extends the ground plane to a ground trace 52 on the lower surface of the first board for ease in soldering to the capacitor terminal. The upper signal trace is connected through a solder joint 90 to the lower signal trace. The ground plane 30, 52 and signal trace 60, 32 are spaced in directions approximately parallel to the plane 89 of the first circuit board 26. There is a gap 62 between the upper ground trace 30 and the upper signal trace 60.

High frequency EMI (electromagnet interference) of a frequency on the order of magnitude of 750 MHz, and especially in the range of 500 MHz to 1000 MHz, can pass though the gaps 54, 62 and reach the circuitry connected to one end of the pins and disrupt such circuitry. The present invention is directed to an improvement that blocks much of such EMI from passing though the connector and reaching such circuitry.

Applicant provides a pair of second dielectric circuit board 70 assemblies, each with a dielectric board 75 and a conductive trace 72 thereon to serve as an EMI shield. Each second board assembly is mounted facewise adjacent, and preferably against, a corresponding first board assembly. Where the first board is a flexible circuit board, the second board is preferably a stiffener board. The conductive shield trace 72 serves as an EMI shield trace, and lies over the gaps 62 between each signal trace 60 and the ground plane 30. Some of the high frequency EMI in the environment moves along paths 76, 78 through the gaps 62. Such EMI is intercepted by the shield trace 72 and prevented from reaching the sensitive circuitry that is connected to the pins. A dielectric cover layer 74 lies against the shield trace 72 and electrically isolates it from the ground and signal traces 30, 60 on the upper surface of the first board.

Applicant provides the shield trace with overlapping ends 80, 82 that extend beyond a shield trace middle portion 84 that lie directly over the gap 62. The overlapping ends 80, 82 lie directly over the ground and signal traces. The overlapping ends block EMI that passes along an angle to the vertical V. The amount of overlap required for good shielding depends upon how close the shield trace 72 is from the gaps. Applicant places the shield trace so it lies vertically no more than one millimeter, and preferably no more than 0.5 millimeter from the closest gap, and places the shield trace closer to the gap than one-tenth the width of the gap. In some cases, the shield trace will lie over a majority of each gap, and preferably at least 90% of each gap, though not all of it.

It is desirable, but not necessary, that the shield trace 72 be electrically connected to the pin 12 and to the signal trace 32. However, it is essential that the signal trace 32 (and 60) be connected to the pin. Such connection is usually done though a solder joint 90. In the arrangement of FIG. 3, the second circuit board assembly 70 would tend to block downward vertical access to the region between the pin 12 and the hole walls 32*h* of the signal trace 32 where solder is to be deposited. Applicant facilitates the deposit of solder (which is later melted as by wave soldering in an oven) by forming the pin-receiving hole 92 in the second board 75 with a notch 100. A dispenser 102 with a narrow dispenser nozzle 104 passes though the notch 100 to dispense solder into or against the region 106 that lies adjacent (preferably within one mm) to both the pin 12 and the signal trace hole walls 32*h*.

Figure 5:
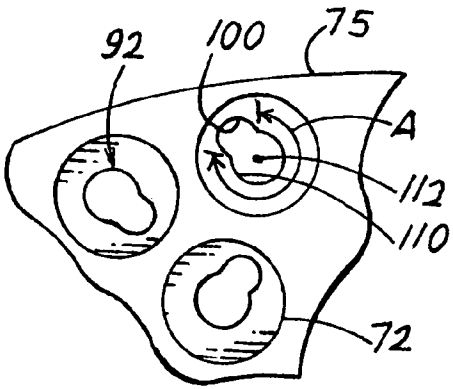
FIG. 5 is a view taken on line 5-5 of FIG. 3, showing the lower side of the second circuit board.

FIG. 5 shows the pin-receiving holes 92 in the second board 75. Each pin-receiving hole 92 includes a circular portion 110 that preferably extends by an angle A of more than 180 degrees about the hole axis 112. The angle A is preferably at least 220°, and is actually 300°. The notch 100 projects radially away from the axis. The circular portion 110 accurately positions the second board hole around the pins. The notch 100 receives the nozzle 104 of the dispenser 102 shown in FIG. 3, so a quantity of tiny balls of solder surrounded by solder flux is deposited at the hole walls. FIG. 3 shows that in many cases the molten solder fillet 90 has a portion 114 that also solders the pin to the shield trace 72 at a side of the hole opposite the notch, which connects the shield trace to the signal trace 32. The solder fillet should always connect to the upper and lower signal traces 32, 60.

Figure 4:
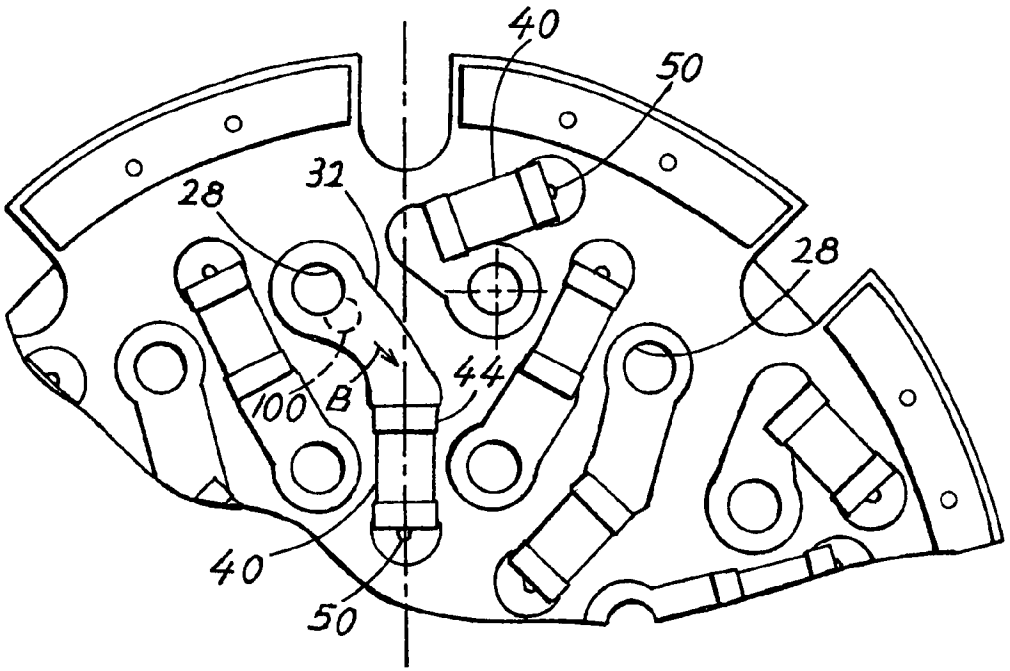
FIG. 4 is a view taken on line 4-4 of FIG. 3, showing the lower side of the first circuit board.

FIG. 4 shows the shape of some of the signal traces 32 that extend from a pin-receiving hole 28 to a terminal of the capacitor 40. Applicant shows in phantom lines, the position of the notch 100 with respect to the signal trace. The signal trace 32 preferably lies under all of the notch 100, so the signal trace is vertically aligned with the notch. That is, the notch extends in the same direction B from the hole 28 as the signal trace 32 extends from the hole towards the component terminal.

To construct the connector of FIG. 3, applicant first constructs the lower and upper assemblies. Then applicant assembles the lower circuit board combination 16 onto the multiple pins 12. This includes placing the lower second circuit board assembly 70, which includes the second board 75, the shield trace 72 and dielectric cover layer 74, over the lower first circuit board assembly 24 which includes the ground and signal traces 50, 32 on a dielectric board 26 and a capacitor 40 soldered in place at each pin-receiving hole, with the pins projecting through the holes. Then, the dispenser 102 (and preferably with many more just like it) is used to lay solder deposits at the walls of the holes in the signal trace. Next, the ferrite beads 20 are placed onto the pins and the upper circuit board assembly, which is identical to the lower board assembly, is placed onto the pins. The dispenser is used to lay solder deposits at the signal trace hole walls. The assembly is placed in an oven to melt the solder, to produce the final assembly shown in FIG. 3.

The fact that a solder deposit (solder balls and flux) was originally deposited within the notch or on the area of the first circuit board 24 that lies under the notch, can be determined from a close inspection of the solder joint. The solder fillet 90 is usually slightly higher at the initial deposit location.

In a connector of the type illustrated in FIG. 3 that applicant has designed, each pin-receiving hole at 32*h* had a diameter of 30 mils (one mil equals one thousandth inch). The first board 26 had a thickness of 5 mils and each second board had a thickness of 30 mils.

Although directions such as "vertical", "lower", "upper", etc. are used to describe the invention as it is illustrated, the invention can be used in any orientation.

Thus, the invention provides an improvement to a connector of the type that has at least one first circuit board assembly with ground and signal traces and with a gap between them though which high frequency EMI (electromagnetic interference) energy can pass if not blocked. The invention provides a second circuit board, such as a stiffener board, with a shield trace thereon, and preferably with a dielectric separation layer over the shield trace. The second circuit board is laid facewise against the first circuit board, and preferably with the separation layer lying against a surface (such as the surface of a ground trace) on the first circuit board. The shield trace covers most, and preferably all, of the gap between signal and ground traces of the first circuit board, and preferably overlaps most of the gap, to intercept EMI that otherwise would pass though the gap. The second circuit board preferably has pin-receiving holes with circular portions and with notches that extend radially away from the hole axes. A dispenser can be inserted through each notch to lay a solder deposit at the walls of the holes in the signal traces that lie on the first board.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. A filtered connector which includes a first circuit board assembly (24) with a plurality of pin-receiving holes (32*h*), a plurality of pins (12) each projecting through one of said holes, a plurality of signal traces (60) each extending at least partially around one of said holes and connected to one of said pins that projects through the hole, a ground plane (30) lying on a surface of said circuit board assembly but spaced from said holes and from said signal traces and leaving gaps (62) between said ground plane and said signal traces, and a plurality of filter components (40) each having a first terminal (42) connected to said ground plane and a second terminal (44) connected to one of said signal traces, comprising:

a second circuit board assembly (70) which lies facewise adjacent to said first circuit board and which has a dielectric second board assembly (75) and a plurality of holes (92) that each receives one of said pins;

a plurality of shield traces (72) lying on said dielectric second board and extending over a majority of the area of each of said gaps.

2. The connector described in claim 1 wherein:

each of a plurality of said conductive shield traces is electrically connected to a corresponding one of said pins.

3. The connector described in claim 1, wherein:

said first circuit board assembly includes a dielectric first board (26) that has upper and lower faces, said ground plane (30) lies primarily on said upper face and including a plated-through aperture (50) in said first board that extends to said lower face, and a ground trace portion (52) on said lower face that connects to said filter component;

said second board is a stiff board, said shield trace lies on a lower face of said second board, and including a dielectric cover layer (74) lying against a lower face of said conductive shield trace;

said second board lies above said first circuit board, with said dielectric cover layer lying facewise adjacent to said ground plane, with said shield trace (72) lying within one millimeter of said ground trace (30) and of said signal trace (60).

4. The connector described in claim 1, wherein:

each of said signal traces is soldered by a solder joint (90) to a corresponding one of said pins, with a location (114) of each of a plurality of solder joints also contacting a corresponding conductive shield trace.

5. The connector described in claim 1, wherein:

each of said holes (92) in said second board assembly is in the form of a circle with an axis (112) and with a notch (100) that extends radially outward from the circular hole;

each of said signal traces is soldered to a corresponding one of said pins by a quantity of solder (90) initially deposited through one of said notches.

6. The connector described in claim 5 wherein:

each of said signal traces extends in a predetermined direction (B) from one of said holes towards the second terminal of one of said filter components, and each of said notches also extends in said predetermined direction (B) from a corresponding hole.

7. A filtered connector which includes a dielectric first board (26) with a plurality of first holes (28) that each has an axis (112), a plurality of pins (12) that each projects through one of said first holes, a plurality of signal traces (32, 60) on said first board that each extends at least partially around one of said holes, at least one ground plane (30) on said board, a plurality of filter components (40) each having one terminal (44) connected to one of said signal traces and a second terminal (42) connected to a ground trace (52) that is connected to said ground plane, comprising:

a dielectric second board (75) with a plurality of second holes (92) and with each of said pins also projecting through one of said second holes, a plurality of shield traces (72) on a face of said second board that is closest to said first board and lying around at least a portion of each second hole, and a dielectric cover layer (74) lying over said shield traces, with each shield trace lying adjacent to one of said signal traces;

said second holes each includes a primarily circular portion extending by an angle (A) of more than 180° about a corresponding pin axis, and a notch (100) projecting further from said axis than said circular portion;

a plurality of solder joints (90) that each joins one of said pins to one of said signal traces, each of said solder joints includes a solder deposit that was deposited through said notch to a location (106) at the intersection of one of said pins and a corresponding one of said signal traces.

8. The connector described in claim 7, wherein:

each of said signal traces is spaced from said ground plane in a direction parallel to a plane (89) of said first board, thereby leaving a gap (54, 62) between them;

each of said shield traces lies over a majority of a corresponding one of said gaps.

9. A filtered connector that includes a plurality of pins (12), and a first circuit board (26) with a plurality of pin-receiving holes (28) each receiving one of said pins, a plurality of signal traces (32, 60) each extending at least partially extending around one of said holes and soldered to one of pins thereat, a ground plane (30), and a plurality of filter components (40) each connected to said ground plane and to one of said signal traces and with a gap (54, 62) between said ground plane and each of said signal traces, including:

a second circuit board (75) having a shield trace (72) lying facewise adjacent to said gap with a dielectric separation layer (74) between said shield trace and the gap;

wherein each of said shield traces (72) is soldered to a corresponding one of said pins by a solder joint (90) that also joins the pin to the corresponding signal trace.

10. A filtered connector that includes a plurality of pins (12), and a first circuit board (26) with a plurality of pin-receiving holes (28) each receiving one of said pins, a plurality of signal traces (32, 60) each extending at least partially extending around one of said holes and soldered to one of pins thereat, a ground plane (30), and a plurality of filter components (40) each connected to said ground plane and to one of said signal traces and with a gap (54, 62) between said ground plane and each of said signal traces, including:

a second circuit board (75) having a shield trace (72) lying facewise adjacent to said gap with a dielectric separation layer (74) between said shield trace and the gap;

wherein said second circuit board includes a plurality of pin-receiving shield holes (110) with axes (112), through which said pins project, each shield trace extending around a majority of each shield hole, each shield hole having a circular portion extending more than 180° around each hole and having a notch (100) that extends radially outward from one side of the hole.

11. The connector described in claim 10 wherein:

said shield trace (32, 60) has a portion that extends in a predetermined direction (B) away from said hole to one of said filter components, and said notch extends in said direction (B) from a hole in said second circuit board.

* * * * *